US006244206B1

(12) United States Patent
Blaisdell et al.

(10) Patent No.: US 6,244,206 B1
(45) Date of Patent: Jun. 12, 2001

(54) STRUCTURAL SYSTEM FOR A MOLDED BOAT HULL

(75) Inventors: George H. Blaisdell, Siler City; Randall L. Sweat, Pittsboro; Richard Pignata, Raleigh; Kevin D. Belcher, Durham, all of NC (US)

(73) Assignee: Genmar Logic, LLC, Durham, NC (US)

( * ) Notice: Subject to any disclaimer, the term of this patent is extended or adjusted under 35 U.S.C. 154(b) by 0 days.

(21) Appl. No.: 09/376,069

(22) Filed: Aug. 17, 1999

(51) Int. Cl.[7] ..... B63B 5/24
(52) U.S. Cl. ..... 114/357; 114/355
(58) Field of Search ..... 114/116, 140, 114/266, 355, 356, 357, 352

(56) References Cited

U.S. PATENT DOCUMENTS

| | | | | |
|---|---|---|---|---|
| 3,002,202 | * | 10/1961 | Luger, Jr. et al. | 114/355 |
| 3,126,557 | * | 3/1964 | Stevens | 114/355 |
| 3,831,212 | * | 8/1974 | Moore et al. | 114/357 |
| 4,917,037 | * | 4/1990 | Hargett, Sr. | 114/357 |
| 5,111,767 | * | 5/1992 | Haines | 114/288 |
| 5,421,283 | * | 6/1995 | Bruggemann et al. | 114/357 |
| 5,634,425 | * | 6/1997 | MacDougall | 114/357 |
| 5,758,594 | * | 6/1998 | Siewert | 114/357 |

FOREIGN PATENT DOCUMENTS

| | | | | |
|---|---|---|---|---|
| 0080980 | * | 5/1982 | (JP) | 114/357 |
| 8806548 | * | 9/1988 | (WO) | 114/357 |

* cited by examiner

*Primary Examiner*—S. Joseph Morano
*Assistant Examiner*—Andrew Wright
(74) *Attorney, Agent, or Firm*—Olive & Olive, P.A.

(57) ABSTRACT

The present invention provides a molded boat hull with a novel structural stiffening system. The boat hull has a number of laterally positioned compartments molded into the inner shell with vertical partitions that are integrally welded to the outer shell and are interconnected to each other and to the transom. A keel plate and a transom support are molded into the transom, the inner wall, and a bridge along the longitudinal center line of the boat. A keel support beam is placed along the keel, connected to the keel plate, and adhered into a channel in the boat hull inner shell. A pair of stringer braces is assembled between the integral stringers to provide transverse stiffness of the boat hull.

12 Claims, 3 Drawing Sheets

STRUCTURAL SYSTEM FOR A MOLDED BOAT HULL

BACKGROUND OF THE INVENTION

1. Field of the Invention

The present invention relates to integrally molded boat hulls, and more particularly to a structural stiffening system for such molded boat hulls.

2. Background of the Invention

The present invention provides an improvement over the rotationally molded boat hull described in U.S. Pat. No. 5,458,844 to MacDougall. While primarily relating to rotationally molded plastics resin boat hulls, the present invention recognizes that the principles described may be applied to a variety of methods of manufacturing boat hulls.

In commercial application, the teachings of the '844 patent apply to small and medium sized recreational and working boat hulls. Once the length of such a rotationally molded boat hull exceeds approximately 5.0 meters (seventeen feet), the operating performance of the boat hull in the water declines. A longer boat presents a greater drive resistance in the water and greater weight to be propelled, generally requiring a more powerful motor. The addition of a more powerful motor further increases the boat's weight. The combined greater weight and greater motor power increase the stress on the boat hull in the water, causing flexure and possibly failure. In order to overcome the stress-induced flexure of longer boats, the structure of the boat hull needs to be stiffened.

Therefore, it is an object of the present invention to provide a stiffening system to enable the production of a molded boat hull of greater length with minimal stress-induced flexure.

It is a further object of the present invention to provide a structural system to be employed in segments according to the design and load characteristics of the boat hull to be produced.

These and other objects will be more fully understood from the description and drawings to follow.

SUMMARY OF THE INVENTION

The structural system for a molded boat hull of the present invention provides stiffening connecting members between portions of the molded boat hull. The boat hull inner shell is molded with a number of wells or bins, forming surrounding partition walls that are substantially vertical and are integrally welded at a long edge to the outer shell of the boat hull. A structural connector, such as a stiff bar, is connected between facing transverse walls of the wells, and a further stiff bar is connected from the rear well to the boat's transom, thus forming a long, stiff longitudinal section to increase the structural stiffness of the boat hull. A central molded longitudinal channel is fitted with an additional longitudinal stiffening member that is fixedly connected to the central portion of the transom. A bracing member is fixedly assembled to connect between longitudinal stringers molded into the boat bottom.

BRIEF DESCRIPTION OF THE DRAWINGS

In order that the invention will become more clearly understood it will be disclosed in greater detail with reference to the accompanying drawings, in which.

DESCRIPTION OF THE INVENTION

Figure 1:
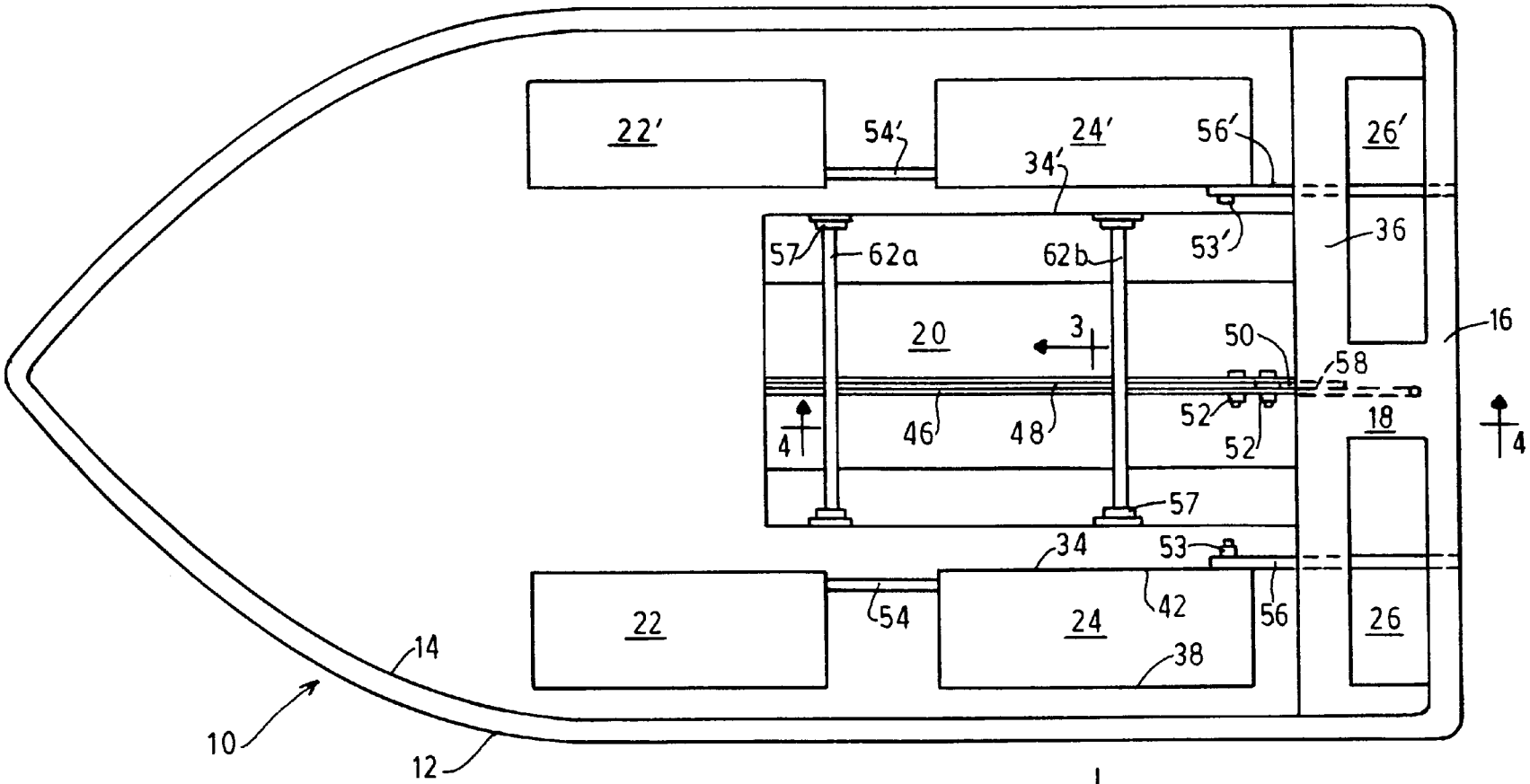
FIG. 1 is a top plan view of a boat hull according to the present invention.
Figure 2:
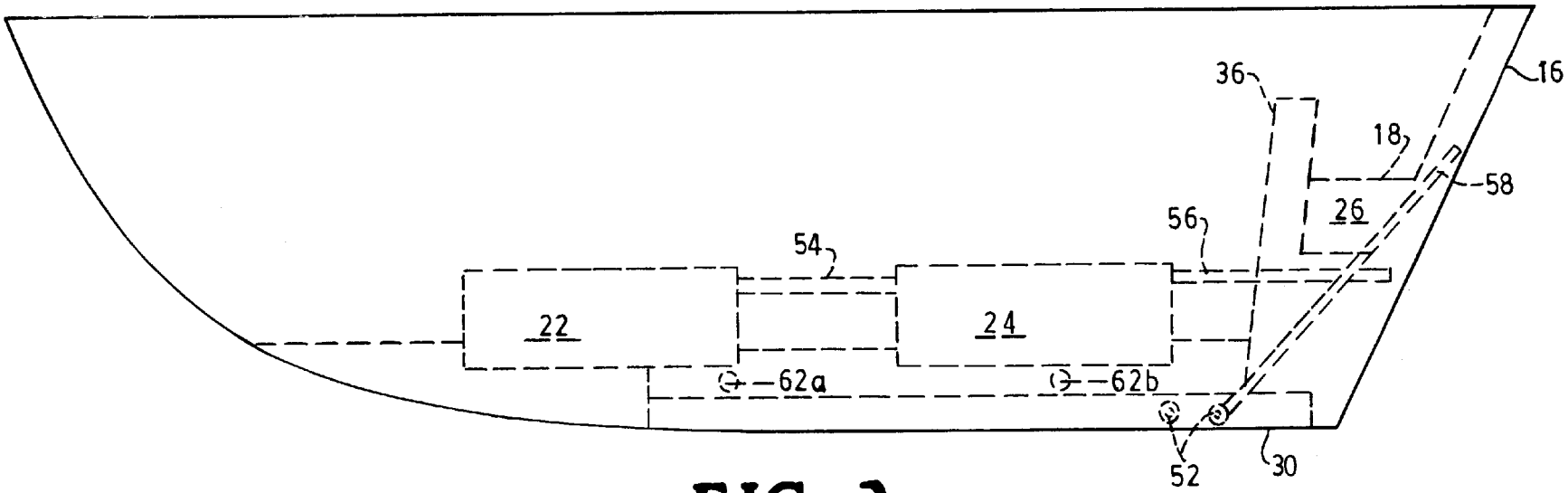
FIG. 2 is a left side elevation view of the boat huff according to the present invention.

FIG. 1 is a top plan view, and FIG. 2 is a side elevation view, showing a molded boat hull 10 which utilizes the structural system of the invention. Boat hull 10 is illustrated in a phase of manufacture prior to the installation of seats, hatches, and the like, for clarity in portraying the features of the present invention. Boat hull 10 is preferably of the type formed by rotational molding a high-density polyethylene resin. As described in U.S. Pat. No. 5,458,844, which is incorporated herein by reference, boat hull 10 is formed of outer shell 12 and inner shell 14 that are integrally welded together along mating edges thereof. As used herein, the term "integral welding" refers to the permanent bonding of two parts of plastics resin when those parts are pressed together as they are cooling and hardening so as to merge along their mating edge.

Referring further to FIG. 1, inner shell 14 of boat hull 10 is formed with a plurality of wells, or bins, as described below. Bilge well 20 is centrally located in the deepest portion of boat hull 10 to collect water that may enter boat hull 10. A first pair of cargo bins 22 and 22' are positioned on port and starboard sides of boat hull 10 in the central portion thereof. A second pair of cargo bins 24 and 24' are positioned toward the rear portion of boat hull 10. Cargo bins 22, 22', 24, and 24' are bordered on their inward sides by stringers 34 and 34'. A pair of splash wells 26 and 26' are positioned adjacent transom 16 to capture water that may wash into the rear of boat hull over transom 16. Splash wells 26 and 26' are bordered on their common forward boundary by inner wall 36 and are separated from one another by bridge 18, which also serves as stabilizing support for transom 16.

Figure 3:
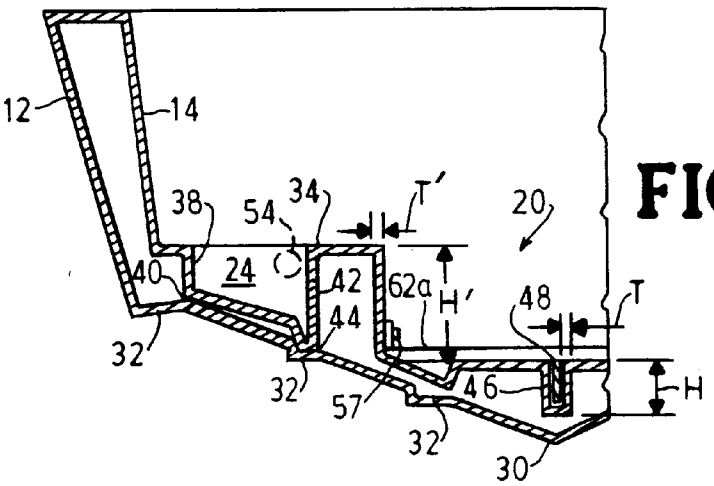
FIG. 3 is a cross sectional view taken in the direction of line 3—3 of FIG. 1.
Figure 4:
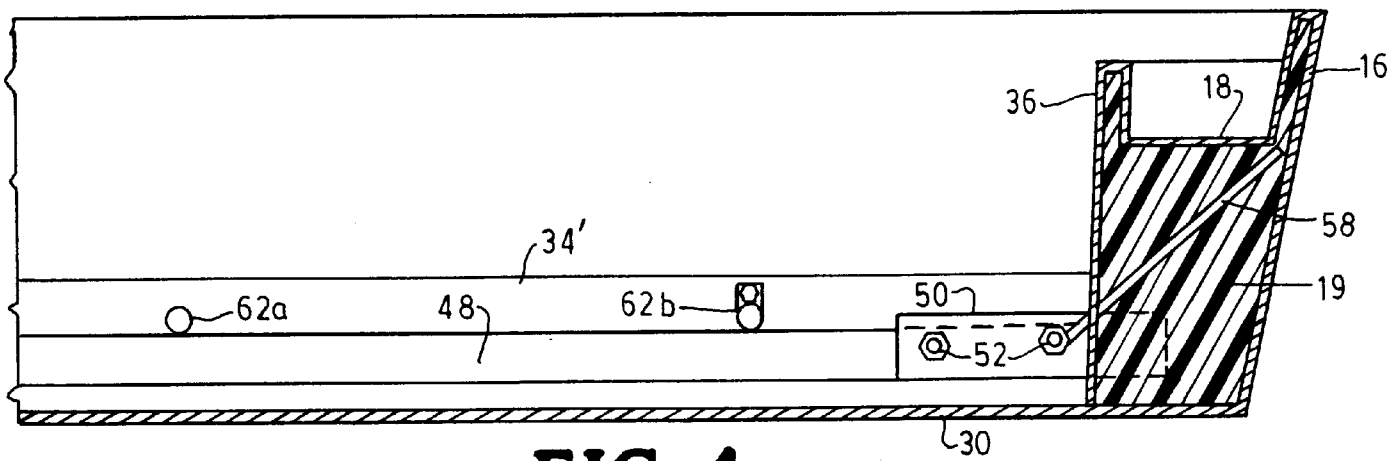
FIG. 4 is a cross sectional view taken in the direction of line 4—4 of FIG. 1.

Continuing with reference to FIG. 1, and with further reference to FIGS. 3 and 4, bilge well 20 includes a longitudinally elongate, substantially narrow, keel channel 46. Keel channel 46 is superimposed over keel 30. Keel channel 46 has a pair of substantially vertically oriented side walls that extend longitudinally of boat hull 10. The side walls of keel channel 46 have a substantially greater height H than thickness T (see FIG. 3), thus providing a stiffening resistance against longitudinal flexure of the bottom of boat hull 10. A keel plate 50 is molded into boat hull 10 by being inserted into the rotational mold before molding boat hull 10, encapsulating its rear portion (closer to transom 16) in the plastics resin of which inner shell 14 is molded. The forward portion of keel plate 50 remains exposed. Transom 16 is reinforced by transom support 58, which is positioned at a selected angle upward, and its lower end is connected to keel plate 50 by bolting or welding. The upper end of transom support 58 is formed with a series of extending fins or bumps on its peripheral surface to lock into the structure of transom 16 and bridge 36. The aft segment of keel plate 50 and the upper end of transom support 58 are molded into the body of inner wall 36 and bridge 18, and the forward segment of keel plate 50 extends forwardly into keel channel 46. A keel support beam 48 is assembled into keel channel 46 after boat hull 10 has been molded so that a rearward end thereof overlaps keel plate 50. Keel plate 50 and keel support beam 48 are each formed with matching transverse holes through which an equal number of fasteners, for example bolts 52, are assembled. Keel plate 50 and keel support beam 48 are preferably formed of high modulus material, e.g., stainless steel for optimum flexural strength. After keel plate 50 and keel support beam 48 are fastened to each other, a filling adhesive is poured into the gap in keel channel 46 therearound to cure and permanently affix keel plate 50 and keel support beam 48 to inner shell 14. A filling adhesive having adequate bond characteristics to the materials involved is "Rule Elastomeric," available from Rule Chemical Company. The void 19 between inner shell 14 and outer shell 12 and within inner wall 36, bridge 34, and transom 16 is filled with a high-density polyurethane foam material. The high density polyurethane, while still light enough to float, is dense enough to rigidify the boat structure, being on the order of 20 pounds per cubic foot.

Referring further to FIG. 1 and FIG. 3, aft storage bin 24, being typical of each of the storage bins 22, 22', 24, and 24', has a vertically oriented planar bin inner partition 42 and vertically oriented bin outer partition 38. Bin inner and outer partitions 38 and 42, each being a planar portion with a substantially greater height H' than thickness T' tend to be relatively stiff against vertical flexure. Bin outer partition 38, being a part of inner shell 14, is integrally welded to outer shell 12 along substantially linear integral weld 40. Bin inner partition 42 is similarly joined to outer shell 12 along integral weld 44. By locating integral welds 40 and 44 at a respective planing strake 32, any differential shrinkage occurring upon cooling of the resin will not significantly affect the slip characteristics of boat hull 10 in water. The assembled structure formed by welding bin inner partition 42 and bin outer partition 38 to outer shell 12 desirably increases the stiffness of outer shell 12 in the connected areas. This stiffness is enhanced by the addition of bin connector 54, a stiff bar member that is insert molded into the juxtaposed ends of forward storage bin 22 and aft storage bin 24, with similar structure being provided on the opposite side of boat hull 10. By preventing forward storage bin 22 and aft storage bin 24 from movement relative to each other, the portion of outer shell 12 therebetween is effectively stiffened.

Referring further to FIGS. 1 and 3, The bottom of outer shell 12 between aft storage bin 24 and splash well 26 is stiffened by the insertion of transom connector 56. Transom connector 56 is a further stiff bar connector, being molded into the structure of transom 16 and inner wall 36, and being fastened, e.g., by bolts 53, to the rear portion of aft storage bin 24. The outer surfaces of bin connector 54 and transom connector 56 are prepared for embedding into the plastics resin during molding, e.g., by providing surface irregularities or end plates. A second transom connector 56' is inserted similarly between aft storage bin 26' and transom 16.

Since the length of boat hull 10 is substantially greater than its beam, flexure in the longitudinal direction requires a greater degree of stiffening. A lesser degree of stiffening in the transverse direction of boat hull 10 is, nonetheless, needed. As seen best in FIG. 1, rigid, elongate stringer braces 62*a* and 62*b* are fastened first and second planar members in the form of to stringers 34 and 34', e.g. by bolts 57, to reside above and transverse to keel support beam 48 between stringers 34 and 34'.

Thus, it will be understood that the desired stiffness of boat hull 10 is provided at the side areas thereof by means of bin inner partition 42 and bin outer partition 38 being each integrally welded to outer shell 12 along integral welds 44 and 40, respectively in conjunction with bin connector 54 and transom connector 56 so as to form a continuous line of bracing the bottom of boat hull 10 from the inception of bow curvature to the transom. Stiffness along keel 30 is provided by the connection of keel support beam 48 and keel plate 50 that is, in turn, connected to transom support 58. Transverse stiffness of boat hull 10 is provided by connecting left and right stringers 34, 34' by stringer braces 62*a* and 62*b*.

While the invention has been described with reference to specific embodiments thereof, it will be appreciated that numerous variations, modifications, and enhancements are possible and are therefore regarded as being within the spirit and scope of the invention that is only limited by the claims to follow.

What is claimed is:

1. A structural system for a molded boat hull, comprising:

a) a first planar portion integrally molded into an inner shell of said boat hull and formed substantially parallel to and offset from a keel thereof;

b) a second planar portion integrally molded into said inner shell and formed substantially parallel to and aligned with said first portion;

c) a substantially rigid first elongate stringer brace fixedly attached to said first planar portion and said second planar portion so as to rigidly connect transversely therebetween;

d) a first transom connector connected at a first end thereof to a third planar portion integrally molded into said inner shell and formed substantially parallel to and aligned with said first portion and molded at a second end thereof into the body of a transom of said boat hull; and e) a second transom connector connected at a first end thereof to a fourth planar portion integrally molded into said inner shell and formed substantially parallel to and aligned with said first portion and molded at a second end thereof into the body of said transom of said boat hull.

2. The structural system for a molded boat hull as described in claim 1, further comprising:

a) an elongate stiffening member installed into an elongate channel formed parallel to and aligned with said keel of said boat hull;

b) means for fixedly connecting said stiffening member into said channel; and c) connecting means assembled between said stiffening member and said transom of said boat hull and adapted to maintain a selected angular relationship between said transom and said keel.

3. The structural system for a molded boat hull as described in claim 2, wherein said connecting means comprises a transom support having a first end connected to said stiffening member and a second end molded into the material forming the transom of said boat hull.

4. The structural system for a molded boat hull as described in claim 1, further comprising a second elongate stringer brace attached to said first planar portion and said second planar portion.

5. The structural system for a molded boat hull as described in claim 1, further comprising irregularities formed on the surface of the second end of the first and second transom connectors.

6. A structural system for a molded boat hull, comprising:

a) an elongate channel formed in a rear portion of said molded boat hull and oriented parallel to and over a keel of said boat hull;

b) an elongate stiffening member located in said elongate channel with a rear portion thereof molded into the body of said boat hull;

c) means for affixing said stiffening member into said channel; and d) a transom support having a first end assembled to said stiffening member and a second end molded into the material forming a transom of said boat hull so as to maintain a selected angular relationship between said transom and said keel.

7. The structural structure for a molded boat hull as described in claim 6, further comprising a stringer brace fixedly assembled from a first stringer to a second stringer of said boat hull in substantially perpendicular relation thereto.

8. The structural system for a molded boat hull as described in claim 6, wherein said means for affixing comprises a filling adhesive.

9. The structural system for a molded boat hull as described in claim 6, wherein said elongate stiffening member comprises a keel plate fixedly connected to a keel support beam.

10. The structural system for a molded boat hull as described in claim 9, wherein an aft portion of said keel plate is integrally molded into an inner shell of said boat hull.

11. The structural system for a molded boat hull as described in claim 6, wherein an aft portion of said elongate stiffening member is integrally molded into an inner shell of said boat hull.

12. The structural system for a molded boat hull as described in claim 6, further comprising extending fins formed on the surface of the second end of the transom support.

* * * * *

UNITED STATES PATENT AND TRADEMARK OFFICE

CERTIFICATE OF CORRECTION

PATENT NO. : 6,244,206 B1
DATED : June 12, 2001
INVENTOR(S) : George H. Blaisdell et al.

It is certified that error appears in the above-identified patent and that said Letters Patent is hereby corrected as shown below:

Column 2,
Line 1, correct "huff" to read -- hull --.

Column 3,
Line 58, after "fastened" please add -- to --.
Line 59, "to" should be omitted.

Signed and Sealed this

Twenty-fifth Day of December, 2001

*Attest:*

*Attesting Officer*

JAMES E. ROGAN
*Director of the United States Patent and Trademark Office*